US011017732B1

(12) United States Patent
Tang

(10) Patent No.: US 11,017,732 B1
(45) Date of Patent: May 25, 2021

(54) BACKLIGHT DRIVING METHOD, BACKLIGHT DRIVING CIRCUIT, AND BACKLIGHT DRIVING DEVICE

(71) Applicant: TCL CHINA STAR OPTOELECTRONICS TECHNOLOGY CO., LTD., Shenzhen (CN)

(72) Inventor: Shijiong Tang, Shenzhen (CN)

( * ) Notice: Subject to any disclaimer, the term of this patent is extended or adjusted under 35 U.S.C. 154(b) by 0 days.

(21) Appl. No.: 16/649,666

(22) PCT Filed: Mar. 9, 2020

(86) PCT No.: PCT/CN2020/078352
§ 371 (c)(1),
(2) Date: Mar. 23, 2020

(30) Foreign Application Priority Data

Jan. 9, 2020 (CN) ..... 202010021101.2

(51) Int. Cl.
*G09G 3/34* (2006.01)
*G09G 3/32* (2016.01)

(52) U.S. Cl.
CPC ..... *G09G 3/3406* (2013.01); *G09G 3/32* (2013.01); *G09G 2310/0286* (2013.01)

(58) Field of Classification Search
CPC ..... G09G 3/3406; G09G 3/32; G09G 3/3614; G09G 3/3233; G06F 3/0446; G02F 1/13318; H05B 45/20; H05B 45/37
See application file for complete search history.

(56) References Cited

U.S. PATENT DOCUMENTS 4,512,656 A * 4/1985 Shinoda ..... G03B 7/0805 396/227
5,177,621 A * 1/1993 Ohtaki ..... H04N 1/00002 358/405
2003/0063078 A1* 4/2003 Hanari ..... G09G 3/3233 345/204
2006/0132424 A1* 6/2006 Foo ..... G02F 1/13318 345/102
2008/0186421 A1* 8/2008 Park ..... G09G 3/3614 349/37
2008/0266241 A1* 10/2008 Kimura ..... G09G 3/3406 345/102
2009/0079358 A1* 3/2009 Shteynberg ..... H05B 45/3725 315/291

(Continued)

FOREIGN PATENT DOCUMENTS

CN 102098055 A 6/2011
CN 102651205 A 8/2012

(Continued)

*Primary Examiner* — Fred Tzeng

(57) ABSTRACT

A backlight driving method for a backlight driving circuit and a backlight driving device includes a first driving signal processing step, a second driving signal processing step, and a backlight driving step. The driving circuit includes a backlight driving module that includes a first processing module, a second processing module, and a driving control module. The first processing module includes a first signal decoding module, a first register module, and a first conversion module, and the second processing module includes a second signal decoding module, a second register module, a second conversion module, and a third conversion module.

10 Claims, 3 Drawing Sheets

(56) References Cited

U.S. PATENT DOCUMENTS

| | | | | |
|---|---|---|---|---|
| 2009/0079359 | A1* | 3/2009 | Shteynberg | H05B 45/37 315/291 |
| 2009/0079360 | A1* | 3/2009 | Shteynberg | H05B 45/20 315/291 |
| 2011/0064391 | A1* | 3/2011 | Hisamoto | H04N 5/775 386/354 |
| 2012/0162134 | A1* | 6/2012 | Chen | G06F 3/0446 345/174 |
| 2017/0287415 | A1 | 10/2017 | Wu et al. | |
| 2020/0254444 | A1 | 8/2020 | Long et al. | |

FOREIGN PATENT DOCUMENTS

| | | | |
|---|---|---|---|
| CN | 105304053 | A | 2/2016 |
| CN | 109126917 | A | 1/2019 |
| CN | 209515173 | U | 10/2019 |

* cited by examiner

Prior Art

BACKLIGHT DRIVING METHOD, BACKLIGHT DRIVING CIRCUIT, AND BACKLIGHT DRIVING DEVICE

FIELD OF INVENTION

The present invention relates to the field of backlight driving technology, and in particular, the present invention is a backlight driving method, backlight driving circuit, and backlight driving device.

BACKGROUND OF INVENTION

A general driving approach of mini light-emitting diodes (mini LEDs) as a backlight is based on various independent devices to compose a driving wiring, where a particular driving method is a manner of driving columns and rows, controlling an operation state of each driving wiring, using properties of thin film transistors to drive mini LEDs on a glass substrate, and thereby realizing brightness control of mini LEDs, as shown in FIG. 3.

However, in a general backlight driving approach, driving wiring often obviously increases as an amount and density of mini LEDs increase, and excessive driving wiring leads to an excessively complicated driving strategy. A large amount of driving wiring necessarily includes a large amount of independent devices, a large amount of independent devices occupies more space of a driving board, and more space occupied and a more complicated driving strategy lead to a very high cost of backlight driving in the end.

Therefore, it becomes a technical problem urgently to be resolved and a key point of researches for people in the technical field how to optimize a backlight driving strategy, simplify backlight driving wiring, and therefore effectively decrease cost of backlight driving.

SUMMARY OF INVENTION

In order to resolve the problem of excessive cost of backlight driving approaches caused by an excessively complicated driving strategy and excessive space of driving wiring occupied existing in conventional backlight driving approaches, an embodiment of the present invention provides a new backlight driving method, backlight driving circuit, and backlight driving device, from two aspects of a backlight driving strategy and a structure of a backlight driving module, resolves problems such as excessive space of a backlight driving board occupied, an excessively complicated backlight driving strategy, and a worse reliability caused by excessiveness of a general driving wiring.

In order to realize the above-mentioned technical purpose, an embodiment of the present invention provides a backlight driving method that includes a first driving signal processing step, a second driving signal processing step, and a backlight driving step, wherein the first driving signal processing step includes: step 10, decoding a first driving signal into a first transistor transistor logic (TTL) electrical level signal; step 11, adjusting the first TTL electrical level signal into a first synchronization signal through performing register processing to the first TTL electrical level signal; and step 12, converting the first synchronization signal into a first control signal through performing electrical level conversion processing to the first synchronization signal; the second driving signal processing step includes: step 20, decoding a second driving signal into a second TTL electrical level signal; step 21, adjusting the second TTL electrical level signal into a second synchronization signal through performing register processing to the second TTL electrical level signal; step 22, converting the second synchronization signal into a second control signal through performing electrical level conversion processing to the second synchronization signal; and step 23, converting the second control signal into a third control signal through performing digital-to-analog conversion processing to the second control signal; and the backlight driving step includes: driving a backlight using the first control signal and the third control signal.

Furthermore, the method further includes following steps, before processing the first driving signal and the second driving signal, obtaining the first driving signal and the second driving signal through a low voltage differential signal interface.

Furthermore, in the backlight driving step, driving the backlight using the first control signal and the third control signal and through a sub-field control.

Furthermore, when driving the backlight through the sub-field control, letting the first control signal be a column driving signal of an active matrix (AM) of the backlight, and letting the third control signal be a row driving signal of the AM of the backlight.

In order to realize the above-mentioned technical purpose, an embodiment of the present invention further provides a backlight driving circuit that includes one or at least two backlight driving modules spliced together, wherein the backlight driving modules include a first processing module, a second processing module, and a driving control module; the first processing module includes a first signal decoding module, a first register module, and a first conversion module, and the second processing module includes a second signal decoding module, a second register module, a second conversion module, and a third conversion module; the first signal decoding module is configured to decode a first driving signal into a first transistor transistor logic (TTL) electrical level signal; the first register module is configured to adjust the first TTL electrical level signal into a first synchronization signal through performing register processing to the first TTL electrical level signal; the first conversion module is configured to convert the first synchronization signal into a first control signal through performing electrical level conversion processing to the first synchronization signal; the second signal decoding module is configured to decode a second driving signal into a second TTL electrical level signal; the second register module is configured to adjust the second TTL electrical level signal into a second synchronization signal through performing register processing to the second TTL electrical level signal; the second conversion module is configured to convert the second synchronization signal into a second control signal through performing electrical level conversion processing to the second synchronization signal; the third conversion module is configured to convert the second control signal into a third control signal through performing digital-to-analog conversion processing to the second control signal; and the driving control module is configured to drive a backlight using the first control signal and the third control signal.

Furthermore, the backlight driving modules include a low voltage differential signal interface module configured to obtain the first driving signal and the second driving signal being processed.

Furthermore, the backlight driving module is a backlight driving module formed through chip on flex (COF) encapsulation.

Furthermore, the backlight is a mini light-emitting diode (LED) backlight, and the backlight driving module is bonded on the mini LED backlight through COF encapsulation.

Furthermore, the first register module and the second register module are a bidirectional shift register.

In order to realize the above-mentioned technical purpose, an embodiment of the present invention further provides a backlight driving device that includes any one of the above-mentioned backlight driving circuits.

Beneficial effects of embodiments of the present invention: Embodiments of the present invention creatively optimize a driving strategy of a backlight, and functional units such as a data string decoding part, a shift register part, an electrical level conversion part, etc. are effectively integrated through a chip on film (COF) encapsulation process, thereby preventing a problem of a large amount of independent devices existing in a backlight driving device, substantially simplifying backlight driving wiring, and further substantially reducing an area occupied by a backlight driving board to make cost of backlight driving lower, stronger reliability and completely resolve many problems existing in a conventional backlight driving approach.

Through a large amount of tests it shows that embodiments of the present invention particularly apply to mini LEDs having good performance, provide a better solution to a backlight driving problem of the mini LEDs, and hence embodiments of the present invention are easily promoted and applied in a wide range.

DESCRIPTION OF DRAWINGS

The accompanying figures to be used in the description of embodiments of the present invention will be described in brief to more clearly illustrate the technical solutions of the embodiments. The accompanying figures described below are only part of the embodiments of the present invention, from which figures those skilled in the art can derive further figures without making any inventive efforts.

DETAILED DESCRIPTION OF PREFERRED EMBODIMENTS

Figure 1:
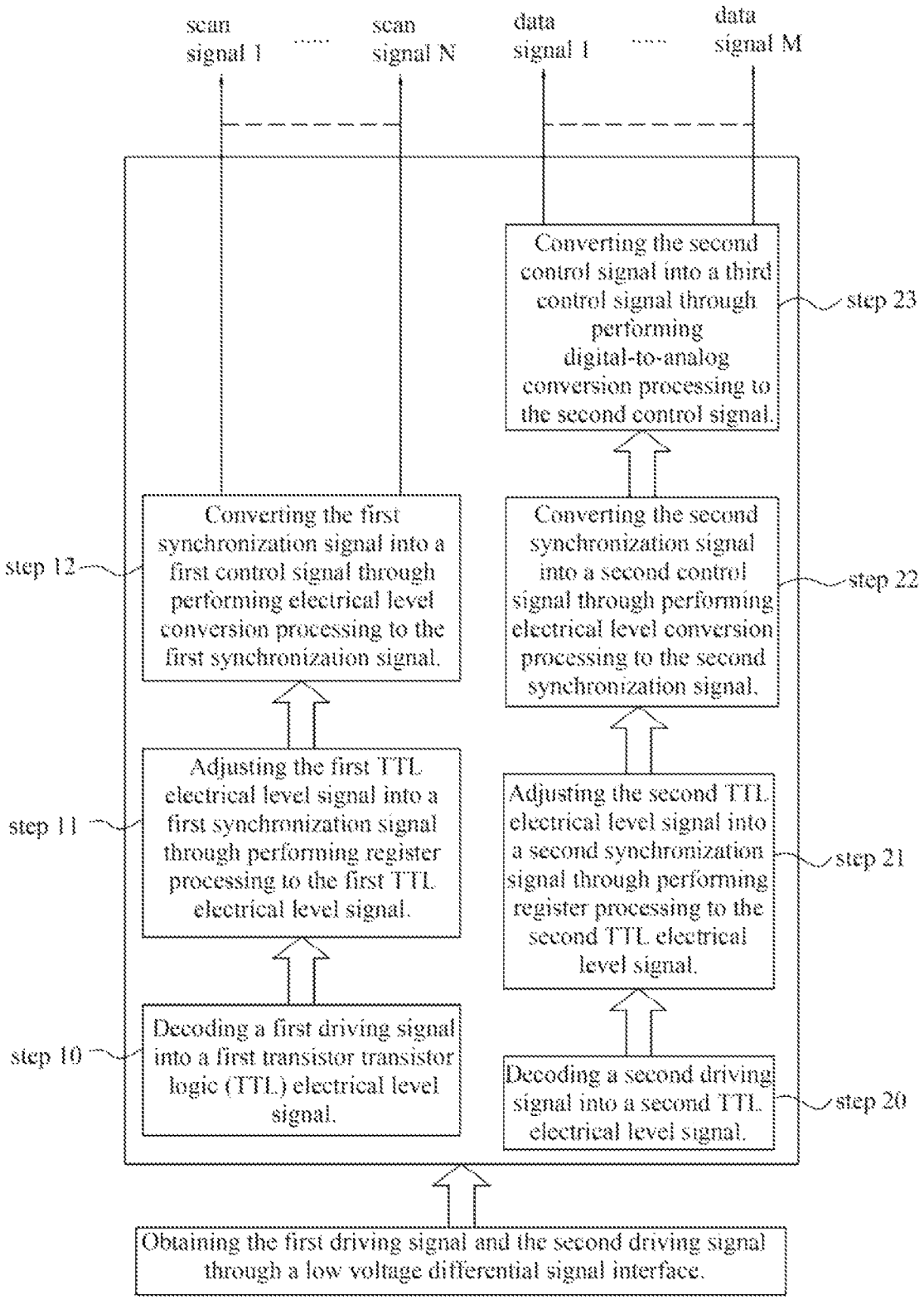
FIG. 1 is a flowchart of a backlight driving method.

The embodiments of the present invention are described in detail hereinafter. Examples of the described embodiments are given in the accompanying drawings. It should be noted that the following embodiments are intended to illustrate and interpret the present invention, and shall not be construed as causing limitations to the present invention. Similarly, the following embodiments are part of the embodiments of the present invention and are not the whole embodiments, and all other embodiments obtained by those skilled in the art without making any inventive efforts are within the scope protected by the present invention.

In description of embodiments of the present invention, it should be understood that terms that indicates orientation or relation of position such as "center", "longitudinal", "lateral", "length", "width", "thickness", "upper", "lower", "front", "rear", "left", "right", "vertical", "horizontal", "top", "bottom", "interior", "exterior" are based on orientation or relation of position accompanying drawings show. They are simply for purpose of description of the present invention and simplifying of description, and do not mean or suggest the devices or components have a specified orientation and constructed and operated in a specified orientation; therefore, it should not be understood as limitation of the present invention. Furthermore, terms "first", "second", and "third" are used simply for purpose of description and cannot be understood to mean or suggest relative importance or implicitly mean amount of the technical features. Therefore, features with terms "first", "second", and "third" can mean or implicitly include one or more of the features. In description of the present invention, "multiple" means two or more unless otherwise clearly and concretely specified.

In embodiments of the present invention, unless otherwise clearly defined or specified, terms such as "mount", "connect", "secure", etc. should be understood in a wide sense. For example, it can be fixedly connected, detachably connected, or one-piece; it can be mechanically connected or electrically connected; it can be directly connected or indirectly connected through an intermediate media; and it can be an internal connection of two devices or effect relation of two devices to each other, unless otherwise clearly specified. For a person of ordinary skill in the art, specific meaning of the above-mentioned terms in embodiments of the present invention can be understood according to specific conditions.

In embodiments of the present invention, the term "illustrative" is used to express "used as an example, a case, or description". Any embodiments described as "illustrative" in embodiments of the present invention are not necessary explained to be more advantageous than other embodiments. In order to make any person of ordinary skill in the art realize and use embodiments of the present invention, following description is given. In the following description, embodiments of the present invention give details for a purpose of explanation. It should be understood that a person of ordinary skill in the art can realize that embodiments of the present invention can be realized even these specific details are not used. In other embodiments, well-known structures and processes are not described in detail to avoid unnecessary details making description of embodiments of the present invention difficult. Therefore, embodiments of the present invention are not to limit described embodiments, and should be in consistent with broadest scope of principles and features disclosed by embodiments of the present invention.

First Embodiment

Referring to FIG. 1, FIG. 1 is a flowchart of a backlight driving method. As shown in FIG. 1, the present embodiment specifically discloses a backlight driving method. The present embodiment can be understood as a backlight module driving method used to realize effective driving and control of light-emitting diodes (LEDs, especially mini LEDs), and the backlight driving method includes a first driving signal processing step, a second driving signal processing step, and a backlight driving step.

First, before processing the first driving signal and the second driving signal, the present embodiment obtains data provided by a previous end (e.g. apparatus processor or controller) through a low voltage differential signal interface. That is, the present embodiment obtains data of the first driving signal and the second driving signal through the low voltage differential signal interface. More specifically, the first driving signal is generally a scan control signal, and the scan control signal specifically includes a clock pulse vertical (CPV) signal, a gate pulse enable (DIO1) signal, an output enable (OE) signal, etc. The second driving signal can be a data control signal, and the data control signal includes a strobe (STB1) signal, a gate pulse enable (DIO2) signal, etc. Please refer to the following description and explanation of a specific processing course of the first driving signal and the second driving signal.

The first driving signal processing step includes:

Step 10, first, the present embodiment decodes the first driving signal into a first transistor transistor logic (TTL) electrical level signal, thereby making the signal capable of being processed by following functional modules (such as register module).

Step 11, second, through performing register processing to the first TTL electrical level signal, the first TTL electrical level signal is adjusted into a first synchronization signal. The present embodiment can perform shift register processing to the first TTL electrical level signal.

Step 12, third, through performing electrical level conversion processing to the first synchronization signal, the first synchronization signal is converted into a first control signal. The first control signal can be a digital control signal that can be used to control conducting or not of a corresponding mini LED; that is, to control turning on or off the corresponding mini LED. It should be noted that during the electrical level conversion processing, the present embodiment can perform control through a thin film transistor (TFT) turn-on electrical level signal (VGH, Driver Output High) or a TFT turn-off electrical level signal (VGL, Driver Output Low), thereby completing control of turning on or off the corresponding mini LED.

It should be understood that the second driving signal processing step can be performed at a same or different time as the first driving signal processing step, and a specific performing strategy can be reasonably chosen according to requirements of a practical display apparatus and real-time performance.

The second driving signal processing step includes:

Step 20, the second driving signal is decoded into a second TTL electrical level signal, thereby making the signal capable of being processed by following functional modules (such as register module).

Step 21, through performing register processing to the second TTL electrical level signal, the second TTL electrical level signal is adjusted into a second synchronization signal. The present embodiment can perform shift register processing to the second TTL electrical level signal.

Step 22, through performing electrical level conversion processing to the second synchronization signal, the second synchronization signal is converted into a second control signal.

Step 23, through performing digital-to-analog conversion processing to the second control signal, the second control signal is converted into a third control signal; that is, the third control signal is an analog control signal. According to a specific value of an analog quantity, brightness of a corresponding mini LED can be indirectly or directly controlled.

The backlight driving step includes that the present embodiment drives the backlight using the first control signal and the third control signal. Specifically, as shown in FIG. 1, scan signals 1-N are configured to control on or off of each mini LED, and data signals 1-M are configured to control brightness of each mini LED. Through simultaneously controlling conducting or not of each mini LED and precise control of brightness of conducting mini LEDs, an embodiment of the present invention can better realize a driving function of a backlight module, realize reliable control of a display apparatus, and bring excellent user experience to users of the display apparatus.

As a better technical solution, an embodiment of the present invention further applies a sub-field control technology. In the backlight driving step, the backlight is driven using the first control signal and the third control signal and through the sub-field control. A specific performing process of the sub-field control is chosen according to requirements, and detail description is omitted in the embodiment of the present invention.

As an optimized technical solution, for a specific backlight module (i.e. backlight), when driving the backlight through the sub-field control, the present embodiment can let the first control signal be a column driving signal of an active matrix (AM) of the backlight, and let the third control signal be a row driving signal of the AM of the backlight. Furthermore, when specifically driving a display screen, a frame of data often includes a plurality of sub-fields. Taking eight sub-fields and refresh rate 120 Hz as an example, when column switches of TFTs of corresponding points are turned on and data is ready, the TFTs of the corresponding points will be charged or discharged. Each sub-field corresponds to a different time length, TFT gate voltage corresponds to mini LED current, change of the TFT gate voltage leads to change of the mini LED current, and the change of the mini LED current controls change of brightness of the mini LED. It can be understood that embodiments of the present invention are suitable for mini LEDs that have significant features such as light weight, high brightness, long lifetimes, low power consumption, self-luminescence, small sizes, quick response times, stronger controllability, etc., and hence embodiments of the present invention have a promising application prospect in the market.

Second Embodiment

Figure 2:
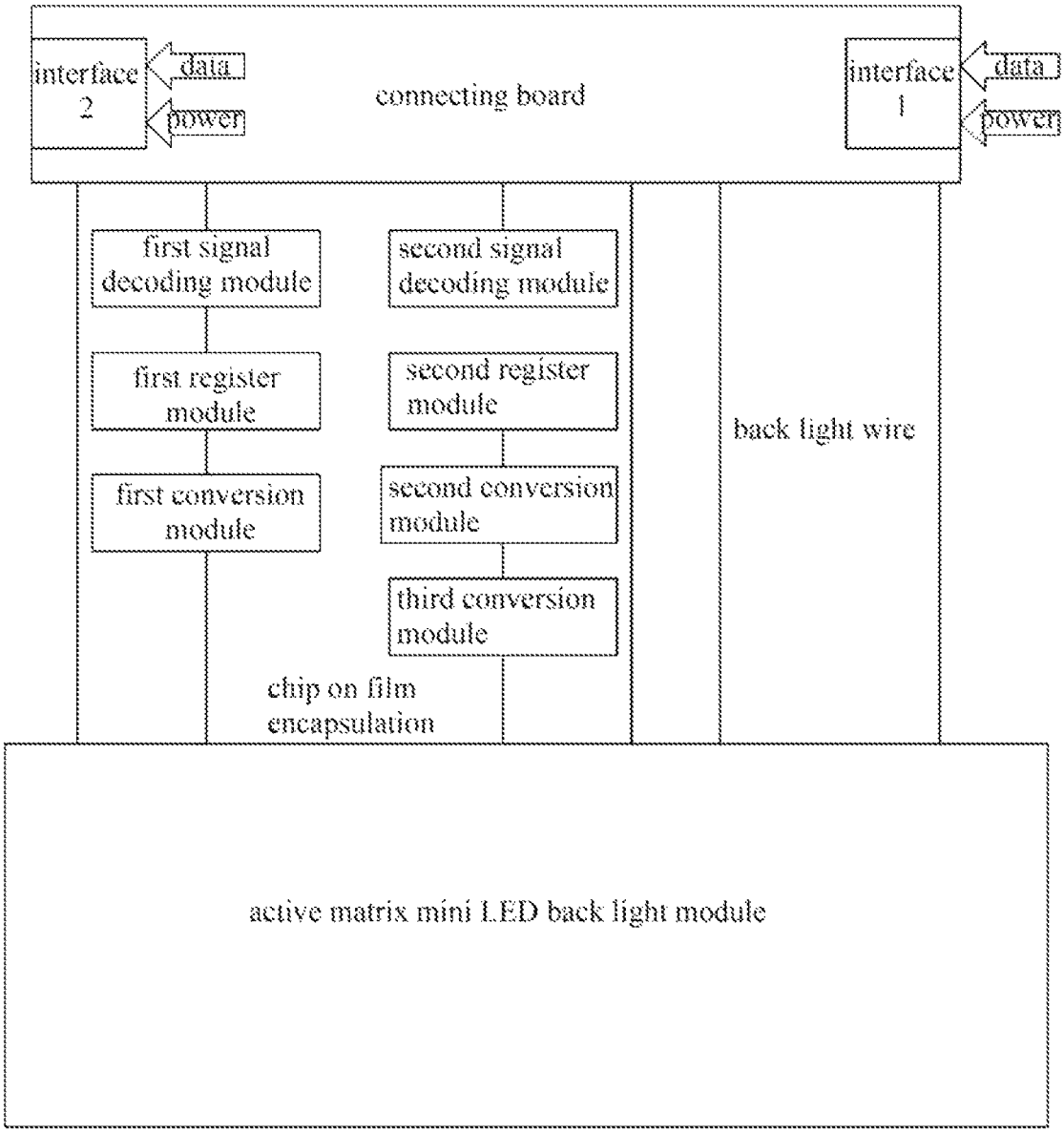
FIG. 2 is a structural schematic diagram of a backlight driving module.
Figure 3:
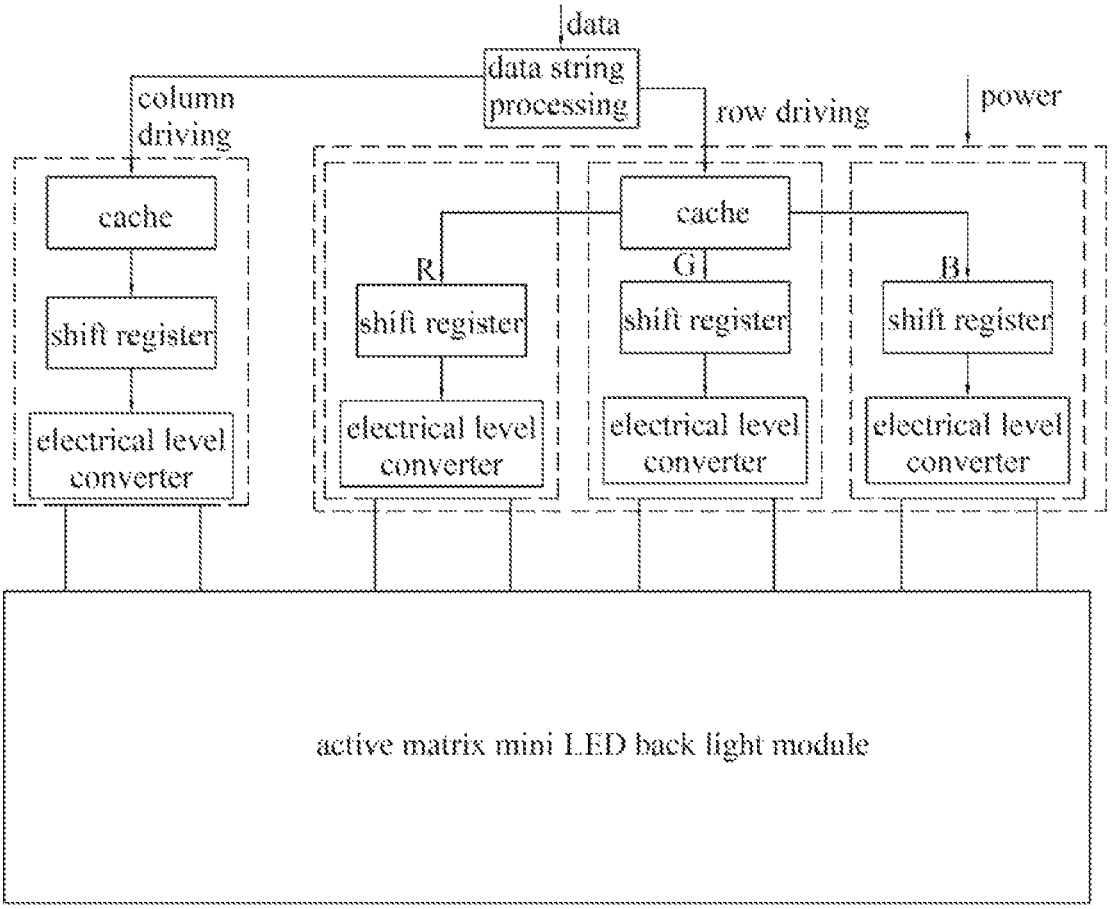
FIG. 3 is a structural schematic diagram of a conventional backlight driving module.

Based on a same invention idea as the first embodiment, the present embodiment specifically provides a backlight driving circuit that can realize the backlight driving method of the first embodiment. The present embodiment equivalently provides one or more driving chips that control AM mini LEDs through sub-field control, the plurality of driving chips can be connected together through splicing or integrating, and the driving chips specifically are integrated circuit (IC) chips. More specifically, the backlight driving circuit includes one or at least two backlight driving modules spliced together, adjacent spliced backlight driving modules can be connected through interfaces in the figure, and interface 1 and interface 2 are configured to transmit data and supply power. The backlight driving modules integrate independent devices on the basis of having functions of conventional approaches. Referring to FIG. 1 and also referring to FIG. 2, FIG. 2 is a structural schematic diagram of a backlight driving module. Only connecting the interface 1 of a connecting board to the interface 2 of another connecting board can realize that a plurality of backlight driving modules are sequentially spliced in designed orientations such as horizontal direction, vertical direction, etc. The backlight driving module includes a first processing module, a second processing module, and a driving control module. Specifically, the first processing module includes a first signal decoding module, a first register module, and a first conversion module. The first signal decoding module, the first register module, and the first conversion module can be sequentially connected. The second processing module includes a second signal decoding module, a second register module, a second conversion module, and a third conversion module. The second signal decoding module, the second register module, the second conversion module, and the third conversion module can be sequentially connected. It should understood that the above-mentioned first processing module, second processing module, driving control module, and sub-modules included in each module are integrated on an IC chip. FIG. 3 is a structural schematic diagram of a conventional backlight driving module. Comparing to the backlight driving device with multiple and separate strings that occupies a larger area in FIG. 3, the present embodiment can provide a brand new technical solution. As shown in FIG. 1 and FIG. 2, functional units such as a data string decoding part, a shift register part, an electrical level conversion part, etc. are effectively integrated through a chip on film (COF) encapsulation process, thereby preventing a problem of a large amount of independent devices existing in a backlight driving device, substantially simplifying backlight driving wiring, and further substantially reducing an area occupied by a backlight driving board to make cost of backlight driving lower, stronger reliability, wider application range, and completely resolve many problems existing in a conventional backlight driving approach. Specific description is as below.

The first signal decoding module is configured to decode a first driving signal into a first TTL electrical level signal, and transmit the first TTL electrical level signal to the first register module.

The first register module is configured to adjust the first TTL electrical level signal into a first synchronization signal through performing register processing to the first TTL electrical level signal, and transmit the first synchronization signal to the first conversion module. As a better technical solution, the first register module is a bidirectional shift register.

The first conversion module is configured to convert the first synchronization signal into a first control signal through performing electrical level conversion processing to the first synchronization signal. During operation of the first conversion module, that is, processing course of electrical level conversion of the first conversion module, the present embodiment can perform control of turning on a corresponding mini LED through a TFT turn-on electrical level signal (VGH, Driver Output High), or perform control of turning off the corresponding mini LED through a TFT turn-off electrical level signal (VGL, Driver Output Low).

The second signal decoding module is configured to decode a second driving signal into a second TTL electrical level signal, and transmit the second TTL electrical level signal to the second register module.

The second register module is configured to adjust the second TTL electrical level signal into a second synchronization signal through performing register processing to the second TTL electrical level signal, and transmit the second synchronization signal to the second conversion module. As a better technical solution, the second register module is a bidirectional shift register.

The second conversion module is configured to convert the second synchronization signal into a second control signal through performing electrical level conversion processing to the second synchronization signal. After finishing conversion, the second control signal is transmitted to the third conversion module.

The third conversion module is configured to convert the second control signal into a third control signal through performing digital-to-analog conversion processing to the second control signal. During a course of converting the second control signal, adjustment of data output voltage amplitude can be realized, that is, adjusting voltage amplitude of the third control signal, thereby changing current of a mini LED corresponding to the voltage amplitude, and achieving more adjustment of brightness values.

The driving control module is configured to drive the backlight using the first control signal and the third control signal. Specifically, as shown in FIG. 1, scan signals 1-N are configured to control on or off of each mini LED, and data signals 1-M are configured to control brightness of each mini LED. Through simultaneously controlling conducting or not of each mini LED and precise control of brightness of conducting mini LEDs, an embodiment of the present invention can better realize a driving function of a backlight module to realize excellent control of a display apparatus, and bring excellent user experience to users of the display apparatus.

In the present embodiment, the backlight driving module further includes a low voltage differential signal interface module. The low voltage differential signal interface module according to an embodiment of the present invention is a mini low voltage differential signal interface (mini LVDS) integrated on a screen driving board (TCON), and is configured to obtain the first driving signal and the second driving signal being processed, and let the obtained first driving signal and second driving signal be a data source of following first processing module, second processing module, and driving control module.

As one of core improvement points or novelty points of an embodiment of the present invention, the backlight driving module according to the present embodiment is a backlight driving module formed through chip on flex (COF) encapsulation. This kind of encapsulation integrates together various functional modules (including the first signal decoding module, the first register module, the first conversion module, the second signal decoding module, the second register module, the second conversion module, and the third conversion module), and substantially saves an area of the backlight driving module; and cost of this approach is lower and additional bonding cost would not produce.

In the present embodiment, the backlight is a mini LED backlight, and the backlight driving module is bonded on the mini LED backlight through COF encapsulation. At least one backlight driving module of the present embodiment is bonded on a glass substrate of AM mini LEDs, thereby realizing driving of the mini LEDs of the backlight module.

Third Embodiment

The present embodiment is based on a same invention idea as the above-mentioned second embodiment. It specifically provides a backlight driving device, and the backlight driving device includes any one of backlight driving circuits provided by the above-mentioned second embodiment. The backlight driving device can be used in display screens of various terminals such as a cell phone, a tablet, a notebook, a personal computer, a smart watch, a smart bracelet, etc. that have a display screen.

The present invention has been described with a preferred embodiment thereof. The preferred embodiment is not intended to limit the present invention, and it is understood that many changes and modifications to the described embodiment can be carried out without departing from the scope and the spirit of the invention that is intended to be limited only by the appended claims.

Industrial utility: Embodiments of the present invention, from two aspects of a backlight driving strategy and a structure of a backlight driving module, resolve problems such as excessive space of a backlight driving board occupied, an excessively complicated backlight driving strategy, and a worse reliability caused by excessiveness of a general driving wiring, and substantially simplify backlight driving wiring, and further substantially reduce an area occupied by a backlight driving board to make cost of backlight driving lower, stronger reliability and completely resolve many problems existing in a conventional backlight driving approach.

What is claimed is:

1. A backlight driving method, comprising a first driving signal processing step, a second driving signal processing step, and a backlight driving step, wherein the first driving signal processing step comprises:

step 10, decoding a first driving signal into a first transistor transistor logic (TTL) electrical level signal;

step 11, adjusting the first TTL electrical level signal into a first synchronization signal through performing register processing to the first TTL electrical level signal; and step 12, converting the first synchronization signal into a first control signal through performing electrical level conversion processing to the first synchronization signal;

the second driving signal processing step comprises:

step 20, decoding a second driving signal into a second TTL electrical level signal;

step 21, adjusting the second TTL electrical level signal into a second synchronization signal through performing register processing to the second TTL electrical level signal;

step 22, converting the second synchronization signal into a second control signal through performing electrical level conversion processing to the second synchronization signal; and step 23, converting the second control signal into a third control signal through performing digital-to-analog conversion processing to the second control signal; and the backlight driving step comprises: driving a backlight using the first control signal and the third control signal.

2. The backlight driving method as claimed in claim 1, further comprising following steps, before processing the first driving signal and the second driving signal, obtaining the first driving signal and the second driving signal through a low voltage differential signal interface.

3. The backlight driving method as claimed in claim 1, wherein in the backlight driving step, driving the backlight using the first control signal and the third control signal and through a sub-field control.

4. The backlight driving method as claimed in claim 3, wherein when driving the backlight through the sub-field control, letting the first control signal be a column driving signal of an active matrix (AM) of the backlight, and letting the third control signal be a row driving signal of the AM of the backlight.

5. A backlight driving circuit, comprising one or at least two backlight driving modules spliced together, wherein the backlight driving modules comprise a first processing module, a second processing module, and a driving control module; the first processing module comprises a first signal decoding module, a first register module, and a first conversion module, and the second processing module comprises a second signal decoding module, a second register module, a second conversion module, and a third conversion module;

the first signal decoding module is configured to decode a first driving signal into a first transistor transistor logic (TTL) electrical level signal;

the first register module is configured to adjust the first TTL electrical level signal into a first synchronization signal through performing register processing to the first TTL electrical level signal;

the first conversion module is configured to convert the first synchronization signal into a first control signal through performing electrical level conversion processing to the first synchronization signal;

the second signal decoding module is configured to decode a second driving signal into a second TTL electrical level signal;

the second register module is configured to adjust the second TTL electrical level signal into a second synchronization signal through performing register processing to the second TTL electrical level signal;

the second conversion module is configured to convert the second synchronization signal into a second control signal through performing electrical level conversion processing to the second synchronization signal;

the third conversion module is configured to convert the second control signal into a third control signal through performing digital-to-analog conversion processing to the second control signal; and the driving control module is configured to drive a backlight using the first control signal and the third control signal.

6. The backlight driving circuit as claimed in claim 5, wherein the backlight driving modules comprise a low voltage differential signal interface module configured to obtain the first driving signal and the second driving signal being processed.

7. The backlight driving circuit as claimed in claim 5, wherein the backlight driving module is a backlight driving module formed through chip on flex (COF) encapsulation.

8. The backlight driving circuit as claimed in claim 5, wherein the backlight is a mini light-emitting diode (LED) backlight, and the backlight driving module is bonded on the mini LED backlight through COF encapsulation.

9. The backlight driving circuit as claimed in claim 5, wherein the first register module and the second register module are a bidirectional shift register.

10. A backlight driving device, comprising the backlight driving circuit as claimed in claim 5.

* * * * *